US012251612B2

(12) United States Patent
Hoang

(10) Patent No.: US 12,251,612 B2
(45) Date of Patent: Mar. 18, 2025

(54) STABILIZED TRAINING APPARATUS

(71) Applicant: Hykso Inc., Costa Mesa, CA (US)

(72) Inventor: Doug Hoang, Costa Mesa, CA (US)

(73) Assignee: Hykso Inc., Costa Mesa, CA (US)

( * ) Notice: Subject to any disclaimer, the term of this patent is extended or adjusted under 35 U.S.C. 154(b) by 218 days.

(21) Appl. No.: 18/110,850

(22) Filed: Feb. 16, 2023

(65) Prior Publication Data

US 2023/0364482 A1 Nov. 16, 2023

Related U.S. Application Data

(60) Provisional application No. 63/342,069, filed on May 14, 2022.

(51) Int. Cl.
*A63B 69/22* (2006.01)

(52) U.S. Cl.
CPC ..... *A63B 69/224* (2022.08); *A63B 2214/00* (2020.08); *A63B 2225/093* (2013.01)

(58) Field of Classification Search
CPC ..... A63B 23/047
See application file for complete search history.

(56) References Cited

U.S. PATENT DOCUMENTS 4,943,057 A * 7/1990 Felder ..... A63B 69/34 473/445
5,624,358 A * 4/1997 Hestilow ..... A63B 69/224 482/90
5,788,612 A * 8/1998 Rennick ..... A63B 69/224 482/90
9,682,301 B2 * 6/2017 Connell ..... H04M 1/72415
D912,753 S * 3/2021 Zheng ..... D21/787
2012/0149534 A1 * 6/2012 Fu ..... A63B 69/22 482/90
2013/0023391 A1 1/2013 Nicholas
2013/0106036 A1 5/2013 Fu et al.
2017/0216679 A1 * 8/2017 McCoy ..... A63B 69/24
2019/0209906 A1 * 7/2019 Ohle ..... A63B 69/0091
2021/0379459 A1 * 12/2021 Czarnecki ..... A63B 69/215
2022/0168621 A1 * 6/2022 D'Alesio ..... A63B 69/305
2023/0226423 A1 * 7/2023 Leavitt ..... A63B 69/222 482/87

FOREIGN PATENT DOCUMENTS

CN 105833506 A 8/2016

OTHER PUBLICATIONS

International Search Report and the written opinion of the international searching authority mailed May 23, 2023 in the International PCT application No. PCT/US 23/13798, (7 pgs).

* cited by examiner

*Primary Examiner* — Zachary T Moore
(74) *Attorney, Agent, or Firm* — North Weber & Baugh

(57) ABSTRACT

Systems and methods for using a lightweight training bag assembly and apparatus provide the punch-feel of common heavy, ceiling-mounted punching bags. Unwanted motion, sound, and other undesirable side-effects associated with existing punching bag designs are successfully avoided. Various embodiments accomplish this by isolating a supporting base from the impact of a punch by using a flexible shaft assembly that translates an angular motion of a shaft into a lateral motion.

20 Claims, 10 Drawing Sheets

STABILIZED TRAINING APPARATUS

CROSS REFERENCE TO RELATED PATENT APPLICATIONS

The present application claims priority benefit, under 35 U.S.C. § 119 (e), to and commonly-assigned U.S. provisional patent application No. 63/342,069, filed on May 14, 2022, entitled "STABILIZED TRAINING APPARATUS", listing as inventor Doug Hoang, which application is herein incorporated by reference as to its entire content. Each reference mentioned in this patent document is incorporated by reference herein in its entirety.

BACKGROUND

A. Technical Field

The present disclosure relates generally to stabilized training equipment. More particularly, the present disclosure relates to stabilized training equipment, such as a punching bag, that provides horizontal and angular resistance and movement in response to an applied force from a user resulting in a more stable and less noisy training apparatus.

B. Background

Physical fitness equipment has transitioned to support a more dynamic workout routine in which a user may exercise in a gym, at home, or other location. Oftentimes a particular piece of fitness equipment, such as a punching bag, is designed for gym use where the environment is noisy and individuals around the equipment are not bothered by its loud operation. Transitioning these types of training equipment for home use presents certain challenges, including noise reduction and mechanical stability to accommodate home use.

Exercise bags come in different sizes, shapes, and structures, including self-supporting free-standing bags that are suspended above a floor or rest on the floor. Generally, punching bags help users to develop and hone a variety of striking skills through practice that involves repetitively striking a relatively hard surface that results in conditioning and strengthening muscles, tendons, and bones of a user's hands, feet, or limbs.

One major shortcoming of conventional free-standing training equipment designs, such as those used in martial arts-type applications, is that they are mounted on a supporting hollow plastic base that are filled with at least 250 lb. and up to 450 lb. or more sand or water to balance the device. These plastic bases oftentimes move and create noise in response to a punch or a kick being applied to the bag. This mechanical instability and noise results in a less desirable deployment of the exercise equipment within a home environment.

Transporting, handling, and storing heavy training equipment is a time-consuming, cumbersome, and user-unfriendly undertaking that deters potential consumers from purchasing and setting up such devices in the first place, especially for home use. Once fully assembled, the device becomes difficult to move and store when not in use.

Accordingly, it would be desirable to have systems and methods that overcome the above-mentioned limitations and provide stabilized training equipment that is more suitable for home use.

BRIEF DESCRIPTION OF THE DRAWINGS

References will be made to embodiments of the invention, examples of which may be illustrated in the accompanying figures. These figures are intended to be illustrative, not limiting. Although the invention is generally described in the context of these embodiments, it should be understood that it is not intended to limit the scope of the invention to these particular embodiments. Items in the figures are not to scale.

Figure ("FIG.") 1 is a side view of a commonly available free-standing-type punching bag assembly in its resting position.

DETAILED DESCRIPTION OF EMBODIMENTS

Figure 1:
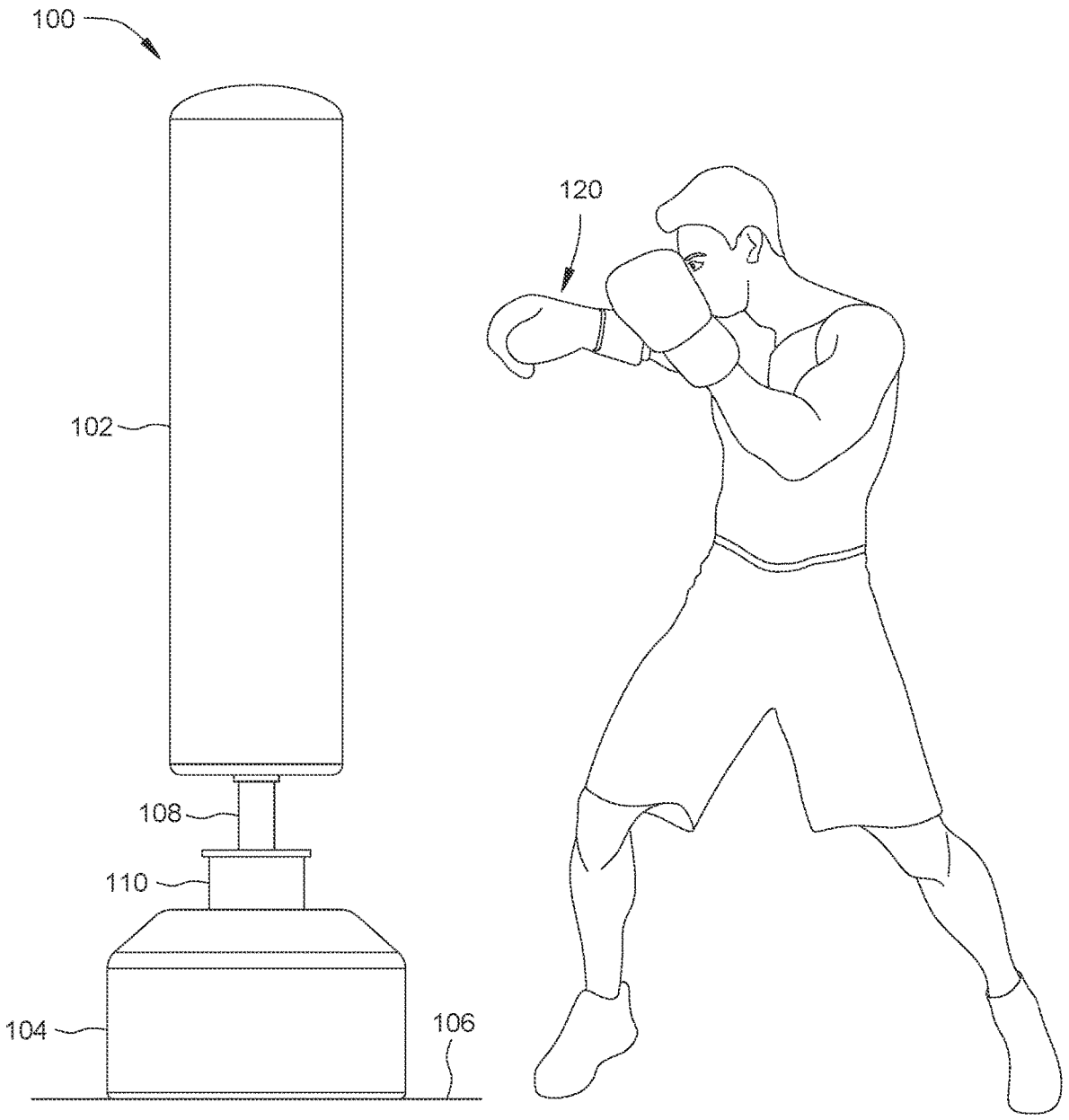
FIG. 1 (PRIOR ART)

In the following description, for purposes of explanation, specific details are set forth in order to provide an understanding of the invention. It will be apparent, however, to one skilled in the art that the invention can be practiced without these details. Furthermore, one skilled in the art will recognize that embodiments of the present invention, described below, may be implemented in a variety of ways, such as a process, an apparatus, a system, a device, or a method on a tangible computer-readable medium.

Components, or modules, shown in diagrams are illustrative of exemplary embodiments of the invention and are meant to avoid obscuring the invention. It shall also be understood that throughout this discussion that components may be described as separate functional units, which may comprise sub-units, but those skilled in the art will recognize that various components, or portions thereof, may be divided into separate components or may be integrated together, including integrated within a single system or component. It should be noted that functions or operations discussed herein may be implemented as components. Components may be implemented in software, hardware, or a combination thereof.

Furthermore, connections between components or systems within the figures are not intended to be limited to direct connections. Rather, data between these components may be modified, re-formatted, or otherwise changed by intermediary components. Also, additional or fewer connections may be used. It shall also be noted that the terms "coupled," "connected," or "communicatively coupled"

shall be understood to include direct connections, indirect connections through one or more intermediary devices, and wireless connections.

Reference in the specification to "one embodiment," "preferred embodiment," "an embodiment," or "embodiments" means that a particular feature, structure, characteristic, or function described in connection with the embodiment is included in at least one embodiment of the invention and may be in more than one embodiment. Also, the appearances of the above-noted phrases in various places in the specification are not necessarily all referring to the same embodiment or embodiments.

The use of certain terms in various places in the specification is for illustration and should not be construed as limiting. A service, function, or resource is not limited to a single service, function, or resource; usage of these terms may refer to a grouping of related services, functions, or resources, which may be distributed or aggregated.

The terms "include," "including," "comprise," and "comprising" shall be understood to be open terms and any lists the follow are examples and not meant to be limited to the listed items. Any headings used herein are for organizational purposes only and shall not be used to limit the scope of the description or the claims. Each reference mentioned in this patent document is incorporate by reference herein in its entirety.

Furthermore, one skilled in the art shall recognize that: (1) certain steps may optionally be performed; (2) steps may not be limited to the specific order set forth herein; (3) certain steps may be performed in different orders; and (4) certain steps may be done concurrently.

Furthermore, it shall be noted that embodiments described herein are given in the context of punching bags for martial arts, but one skilled in the art shall recognize that the teachings of the present disclosure are not limited since a training bag may be used by any person who physically strikes a training bag using a body part or object, such as a tool, weapon, or other instrument. Therefore, the disclosure encompasses applications that do not need necessarily be related to martial arts applications, i.e., various embodiments may equally be used in other contexts.

In this document the term "training bag" refers to a practice device that serves as a target to which a force is applied, e.g., for practicing martial arts or other activities. The term "plastic" includes any elastomer recognized by one of skilled in the art.

FIG. 1 depicts a commonly available free-standing-type punching bag assembly in its resting position. Punching bag assembly 100 comprises top portion 102 having a cylindrical shape, shaft 108, and base 104 that rests on floor 106. As shown in FIG. 1, shaft extends from top portion top 102 and is coupled to base 104 by coupling means 110. The resulting combined structure acts as a relatively rigid single body having a greatly uneven mass distribution along its axis (not shown).

Top portion 102 of punching bag assembly 100 typically consists of some type of cushioning material, e.g., a foam body encapsulated by a vinyl cover. Base 104 is fillable with typically hundreds of pounds of filling material, e.g., through a relatively small opening port into which the user must pour sand or water in what amounts to a cumbersome user-unfriendly maneuver. This drawback alone deters a great number of potential consumers from purchasing and setting up punching bag assembly 100 and for more sophisticated equipment, which comprises feedback sensors such as motion trackers and other measurement devices, also drastically increases subscription activation time.

Figure 2:
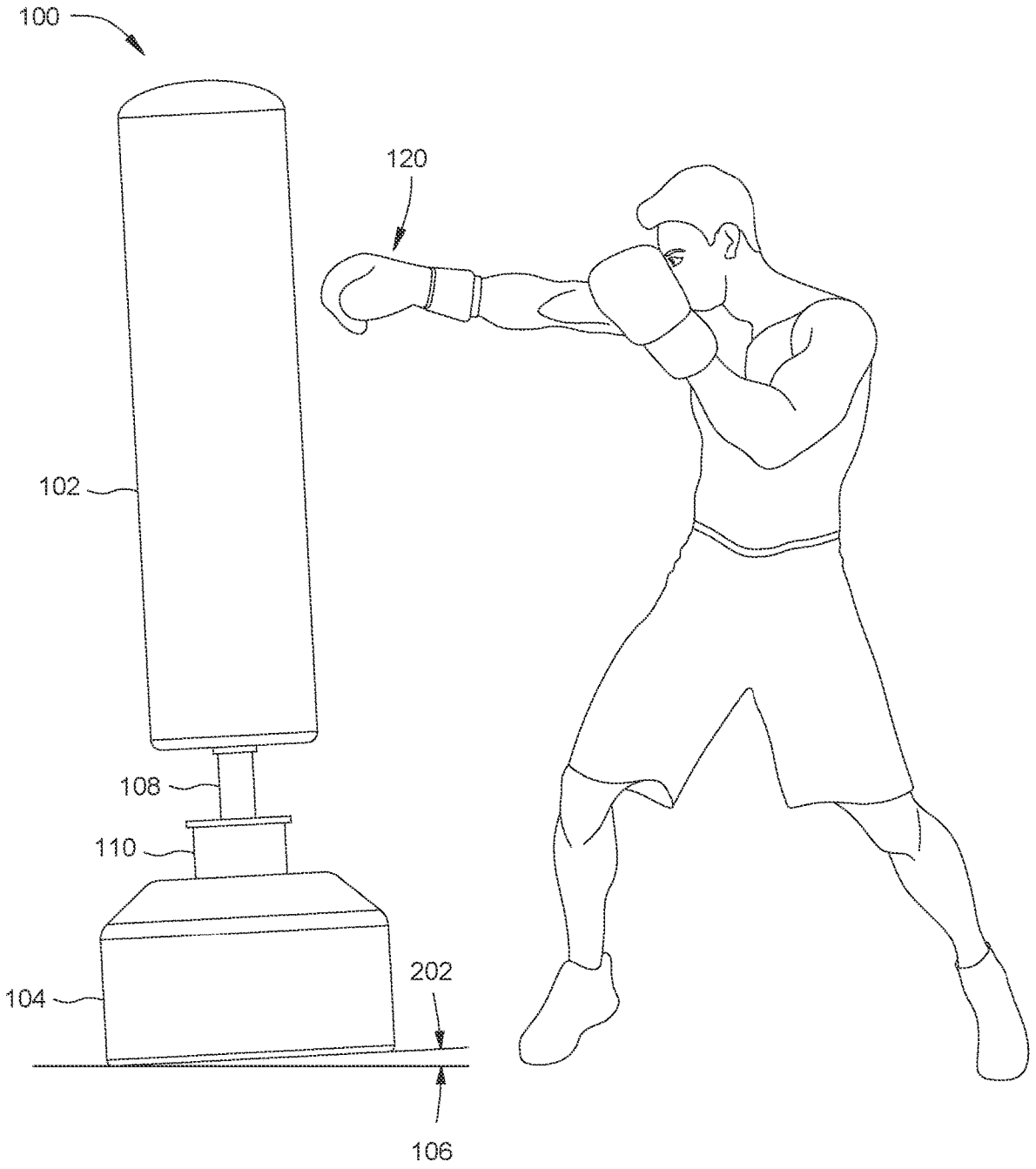
FIG. 2 (PRIOR ART)
FIG. 2 depicts the punching bag assembly of FIG. 1 in a deflected position following a punch.

In operation, once a user applies a force in the form of kinetic energy to an area of top portion 102, e.g., by a strike or kick with object 120, shaft 108 that extends through top portion 102 will transform that force, at least in part, into angular momentum resulting in a rotational force. The rotational force will accelerate top portion 102 away from object 120 due to a torque that is developed and, if sufficiently great, will cause one side of base 104 to lift off floor 106 by some angle 202 shown in FIG. 2.

Typically, the amount of lift is proportional to the force exerted on punching bag assembly 100. Once the force applied to top portion 102 is released, the relatively heavy (e.g., 450 lbs.) base 104 that was lifted will be pulled back by a gravitational force and, thus, accelerate back towards floor 106. Once base 104 lands back on floor 106, an undesirable audible noise will be created upon impact. After rocking back and forth in an oscillatory movement during a settling time, top portion 102 will resume its original position shown in FIG. 1, unless a subsequent force is applied to top portion 102 prior to that. Unwanted noise may be generated each time top portion 102 experiences a relatively strong punch whose force is sufficiently large to lift base 104 off floor 106, making existing training bag designs, such as punching bag assembly 100, impractical for home use. Existing attempts to mitigate this include requiring additional acoustic damping material to be placed underneath base 104 to absorb the force and, thus, reduce noise.

Another shortcoming aside from base 104 slamming on floor 106 is that base 104 also tends to slide across floor 106, opposite to the direction the punch is applied. This resulting lateral motion largely depends on the surface material of floor 106, i.e., the relative friction between the surface material of floor 106 and the surface material of base 104. This unwanted side-effect and the fact that the user has to repeatedly move the entire weight of punching bag assembly 100 back to its original position on floor 106. Users typically perceive such undesirable side-effects as disrupting their workout experience.

Further, the weight of punching bag assembly 100 makes it difficult to move punching bag assembly 100 to a storage location, e.g., each time when it is not in use. Furthermore, while the overall punching bag assembly 100 is very heavy due to the weight of base 104 when base 104 is properly filled, top portion 102, which is made of light-weight foam material, is relatively light. However, light-weight top portion 102 results in a different and less desirable punch-feel when compared to a common heavy ceiling-mounted sand-filled leather punching bag.

In detail, top portion 102 is relatively loosely secured to punching bag assembly 100 in a manner such as to cause the user to feel a relatively large amount of deflection that greatly differs from the feel of punching a heavy ceiling-mounted sandbag. This mainly due to the fact that, unlike the inertia of a heavy punching bag, which provides a relatively large resistance to the force that is exerted by the user and absorbed by the training bag, top portion 102 of punching bag assembly 100 provides inadequate training resistance. This phenomenon is exacerbated with increasing force applied to top portion 102. This shortcoming renders punching bag assembly 100 unsuitable for advanced and professional use.

In contrast, embodiments herein advantageously provide the punch-feel of training with a common heavy ceiling-mounted sand-filled leather punching bag. At the same time, this aids users to build and maintain more muscle tissue than is possible with existing free-standing training bag designs. Advantageously, various embodiments accomplish this while reducing the risk of wrist or ankle injuries, typically associated with striking a heavy or dense training bag with high impact.

Figure 3:
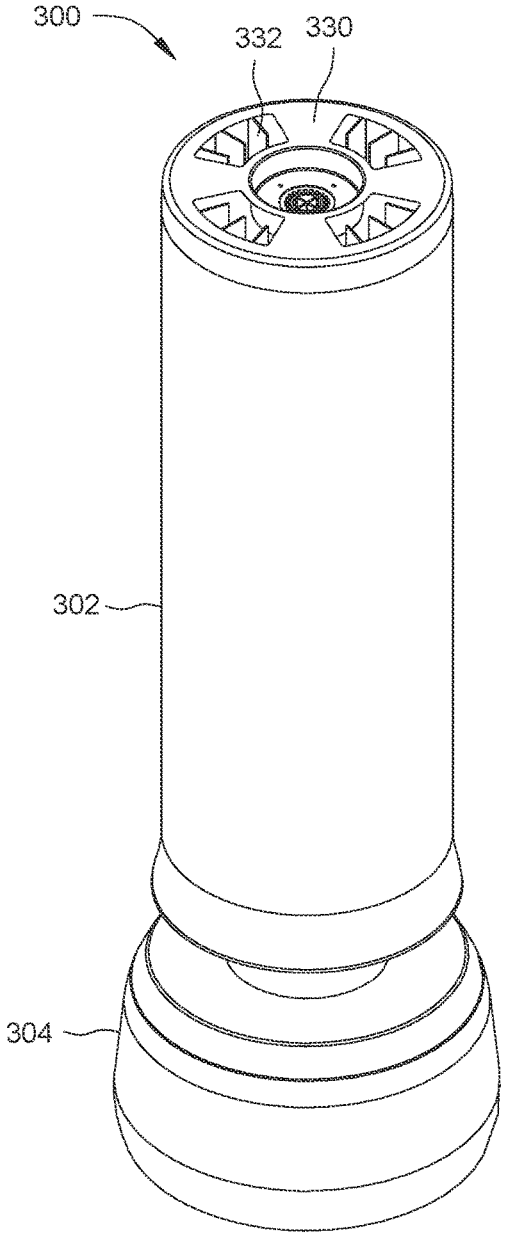
FIG. 3 is a perspective view of a training bag assembly, according to various embodiments of the present disclosure.
Figure 4:
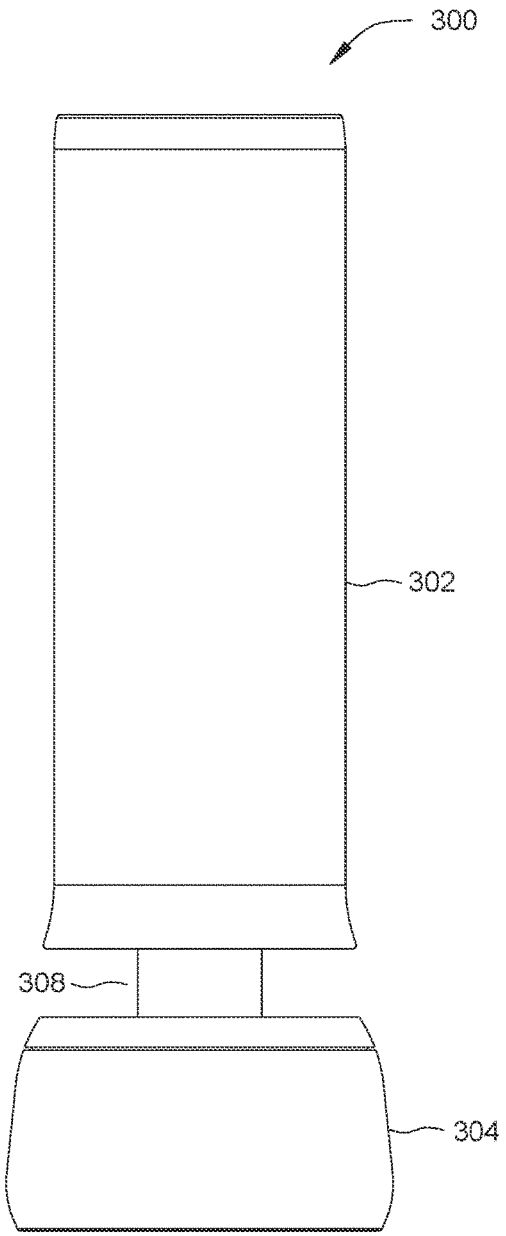
FIG. 4 is a side view of a training bag assembly, according to various embodiments of the present disclosure.

FIG. 3 is a perspective view of a training bag assembly, and FIG. 4 is a side view of a training bag assembly, according to various embodiments of the present disclosure. In embodiments, training bag assembly 300 comprises top portion 302, shaft assembly 308, and base 304. Top portion 302 may comprise any suitable durable material, such as plastic, nylon, polycarbonate that has high-impact resistance, high elasticity, and other desirable mechanical, chemical, and other properties. Suitable properties include mechanical and acoustic damping, elasticity, and a lack of hysteresis effects. As an example, top portion 302 may comprise a relatively rigid polymer material, such as a thermoplastic elastomer, e.g., thermoplastic polyurethane (TPU) that may be combined with resilient foam material to provide additional padding to top portion 302. Such polymers may be advantageously implemented into a striking area of top portion 302 to absorb energy during operation.

In embodiments, base 304 may be produced from, e.g., a blow-molded plastic material, such as high density polyethylene, to create a "hollow" enclosure that can hold a liquid, a gel, or any other suitable filling material or combination thereof. In operation, base 304 may be as a ballast that counterbalances the forces applied to top portion 302. A person of skill in the art will appreciate that for liquid or gel-like filling materials (e.g., elastomers), some, or all of base 304 may be hermetically sealed to prevent undesirable leakage.

As discussed in greater detail below, the strategic combination of components from which training bag assembly 300 is constructed isolate base 304 from the rest of the bag. This, advantageously, inhibits unwanted motion, sound, and other side-effects associated with existing punching bag designs. Certain embodiments may accomplish this without having to procure and fill base 304 with, e.g., 300 lbs. or more filling material. In certain embodiments, base 304 may comprise an auxiliary bag ring (not shown) that may be located adjacent to the perimeter of base 304 to prevent base 304 from sliding across a slippery floor when top portion 302 is struck by a high-energy punch.

Figure 5A:
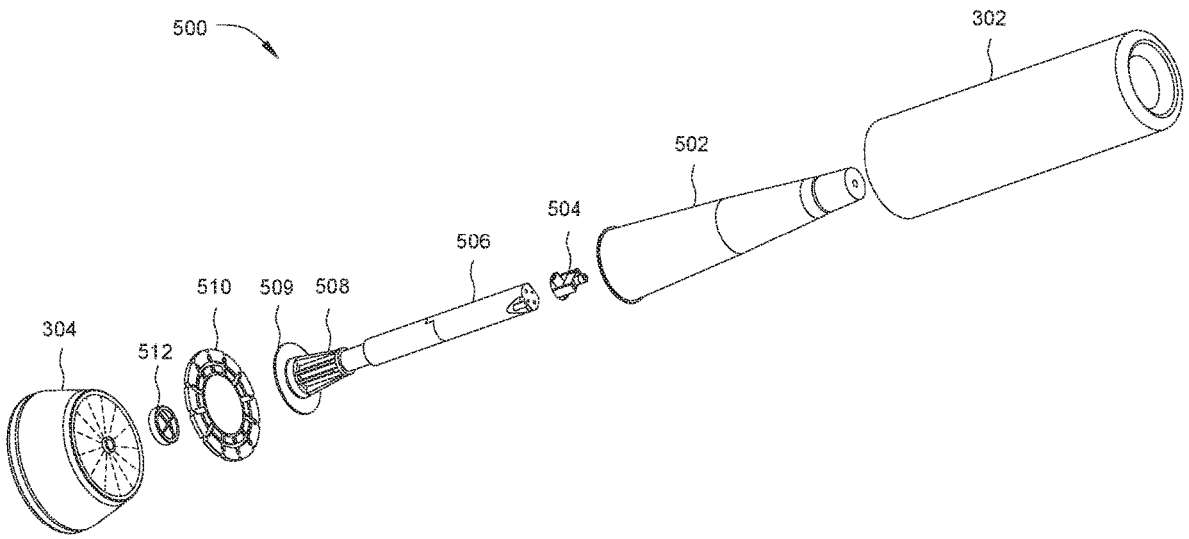
FIG. 5A is an exploded view of a training bag assembly, according to various embodiments of the present disclosure.

FIG. 5A is an exploded view of a training bag assembly, according to various embodiments of the present disclosure. Same numerals as in FIG. 3 denote similar elements. In embodiments, training bag assembly 500 may comprise top portion 302, cone assembly 502, gimbal 504, shaft assembly 506, intermediate shaft spring 508, sliding plate 509, sliding plate cover 510, shaft spring 512, base top plate 514, and base 304. It is noted that components depicted in FIG. 5 need not necessarily be assembled in the order or orientation shown therein. For example, a person of skill in the art will appreciate that optional sliding plate cover 510 may be mounted to the top surface of sliding plate 509, facing base 304.

In embodiments, top portion 302 may be mounted on cone assembly 502, which in operation moves, along with shaft assembly 506, due to the operation of gimbal 504. in embodiments, gimbal 504 may be implemented as a two-axis gimbal, as shown in FIG. 5. One person of skill in the art will appreciate that any other structure, such as a ball-and-socket structure, may equally be employed in lieu of two-axis gimbal 504. A person of skill in the art will further appreciate that gimbal 504 need not be limited to two-axis designs and may equally be implemented as a three-axis structure, e.g., to allow for a certain amount of travel in a third direction along the axis of shaft assembly 506. Furthermore, embodiments of the invention may use a spring that facilitates translational movement as well as two-axis rotation.

In embodiments, gimbal 504 may comprise high-stiffness fatigue and wear-resistant materials and may be positioned relatively close to one end of cone assembly 502 to allow top portion 302 to pivot around gimbal 504 to perform angular and/or translational movements similar to those of a traditional hanging punching bag. Similarly, shaft assembly 506 and intermediate shaft spring 508 may comprise relatively high-stiffness, high fatigue-resistant materials, such as metal (e.g., die cast aluminum) or TPU having a relatively high plastic content. This is understood that any material mentioned herein may be produced using any manufacturing process known in the art, such as a sintering or molding process, e.g., plastic injection molding.

In embodiments, intermediate shaft spring 508 may be implemented as having a conical structure that extends from the outer surface of shaft assembly 506 to sliding plate 509. Sliding plate 509 may be implemented as a low-friction component that acts a part of a low-friction bearing, e.g., a ball bearing that comprises top of base plate 514. As depicted in FIG. 5, in embodiments, sliding plate cover 510 may comprise any number of recesses that may receive balls. The thereby formed ball bearing structure allows for low-friction longitudinal movement of sliding plate 509. In operation, sliding plate 509 travels by a certain amount determined, at least in part, by shaft spring 512, which restricts the motion of sliding plate 509. Once shaft spring 512, which may be mounted onto base top plate 514, decompresses, shaft spring 512 may cause shaft assembly 506, including sliding plate 509 to travel in direction of their neutral position, i.e., their position when training bag assembly 500 is not in use.

In embodiments, intermediate shaft spring 508 may serve as a damping device that, in operation, may absorb at least some of the energy transferred to top portion 302, e.g., by virtue of a strike to top portion 302, which may cause sliding plate 509 to travel and shaft 506 to compress spring 512. In embodiments, spring 512 may further absorb some of the energy, thus, reducing the amount of torque that would otherwise be transferred to base 304. As a result, base 304 may at least partially be isolated from top portion 302 and/or shaft assembly 506, i.e., from the effect of the force applied top portion 302. It is noted that both shaft spring 508 and shaft spring 512 may be implemented from any material and in any arbitrary shape that can absorb energy and aid in isolating base 304 from top portion 302 and/or shaft assembly 506. For example, shaft spring 512 may be implemented as a progressive spring that exhibits a greater stiffness and damping with increasing compression caused by the deflection of shaft assembly 506.

Overall, the combination of several components advantageously isolates base 304 at least partially from impact on rest of the training bag assembly 500. In addition, in embodiments, base 304 may comprise, or be placed adjacent to, a structure at least partially surrounds base 304, such as a base ring (not shown) that may comprise a number of sections, such as plastic stops that limit movement of base 304 across a slippery floor. Alternatively, a high-friction mat (also not shown) or equivalent may be placed underneath base 304 to restrict unwanted movement and the noise associated therewith.

Figure 5B:
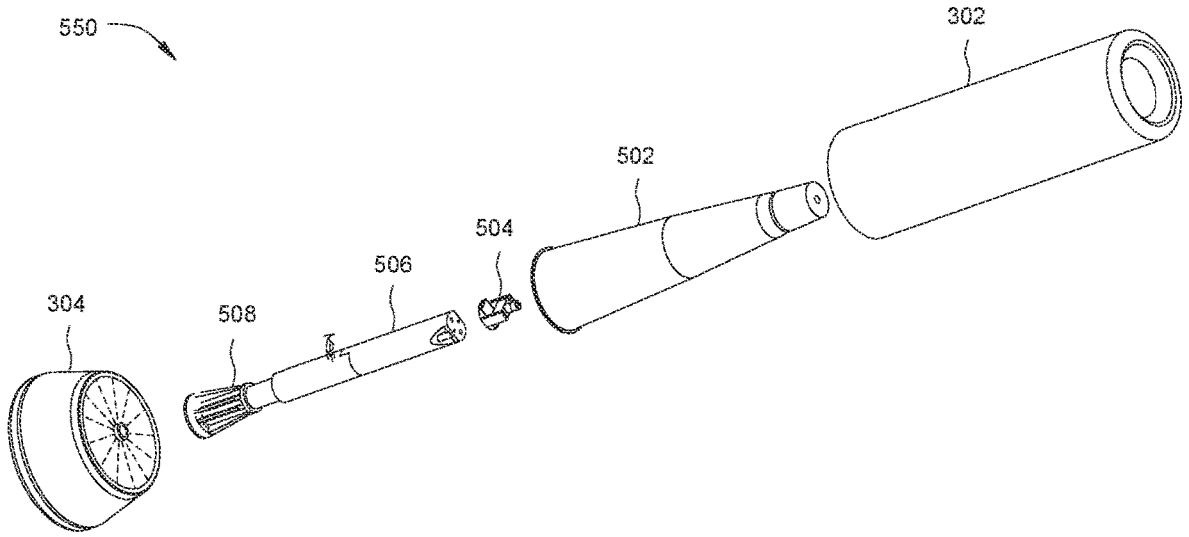
FIG. 5B is an exploded view of another training bag assembly, according to various embodiments of the present disclosure.

FIG. 5B is an exploded view of another training bag assembly, according to various embodiments of the present disclosure. For clarity, components similar to those shown in FIG. 5A are labeled in the same manner. For purposes of brevity, a description or their function is not repeated here. As depicted in FIG. 5B training bag assembly 550 need not comprise a sliding plate that moves on ball bearings located on a sliding plate cover that attached to base 304. Instead, in embodiments, training bag assembly 550 may comprise intermediate shaft spring 508 that may mounted to a top surface of base 304, e.g., by a number of fasteners to restricts the motion of the bottom part of shaft spring 508. As with shaft spring 508 in FIG. 5A, shaft spring 508 in FIG. 5B may be implemented as having any geometry and material stiffness.

In operation, shaft spring 508 may absorb energy from lateral motions of shaft 506 without transferring all or any part of that energy to base 304, in effect, reducing the torque shaft spring 508 may that would otherwise transfer to base 304. In this manner, shaft spring 508 may isolate motions of shaft 506 from base 304 to a certain degree. As in FIG. 5A, base 304 may thus be at least partially isolated from top portion 302 and/or shaft assembly 506, i.e., from the effect of the force applied top portion 302.

It is understood that training bag assemblies 500 and 550 illustrated in respective FIG. 5A and FIG. 5B are not limited to the constructional detail shown there or described in the accompanying text. As those skilled in the art will appreciate, components may be combined in various configurations. Further, training bag assemblies may comprise any combination of components not expressly mentioned herein, such as couplers, fasteners, and other components helpful in accomplishing the objectives of the present disclosure. Furthermore, other geometries and materials having suitable mechanical properties may be used to implement the teachings of the present disclosure without departing from the spirit of the invention.

Figure 6:
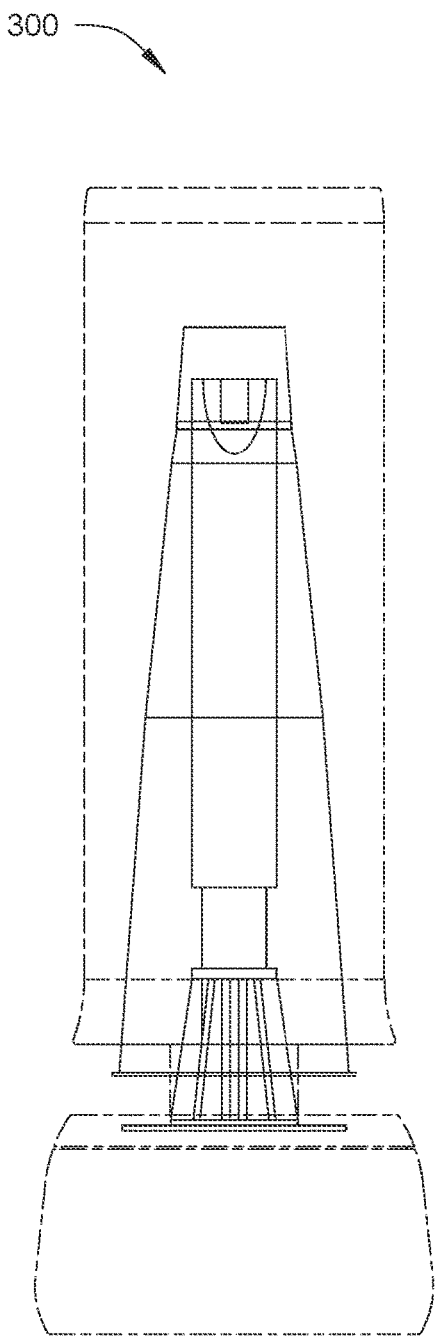
FIG. 6 depicts a cross section of a training bag assembly comprising a sliding plate in a resting position, according to various embodiments of the present disclosure.
Figure 7:
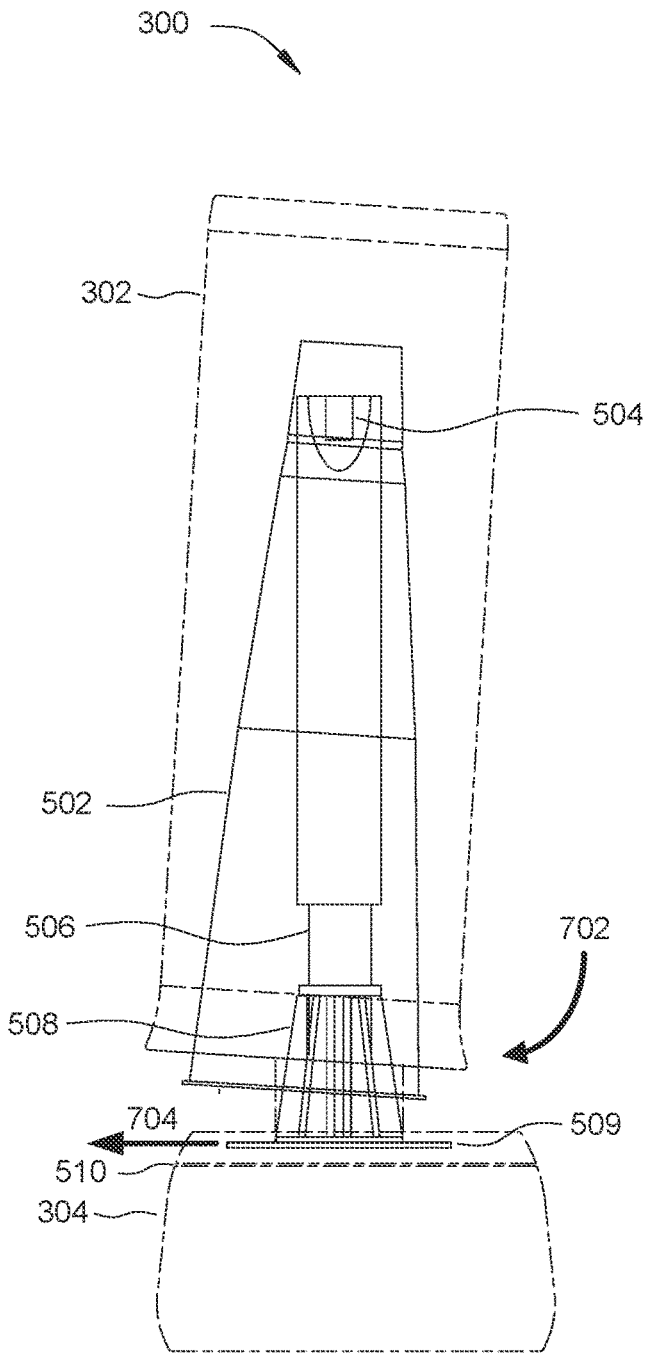
FIG. 7 depicts a cross section of a training bag assembly comprising a sliding plate in a deflected position, according to various embodiments of the present disclosure.
Figure 8:
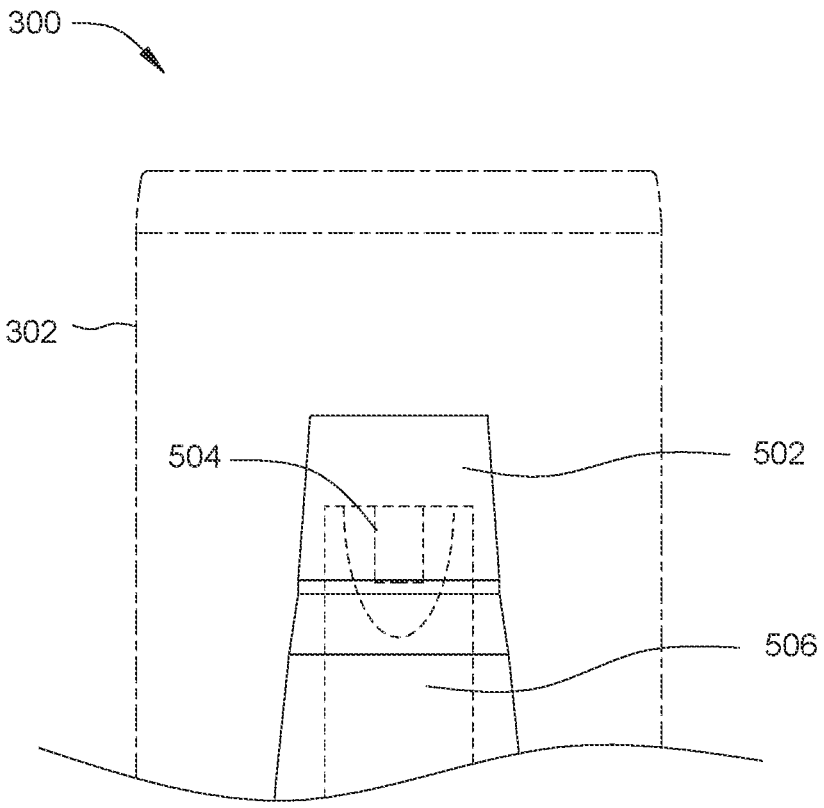
FIG. 8 depicts a cross section of the gimbal area of training bag assembly shown in FIG. 6.
Figure 9:
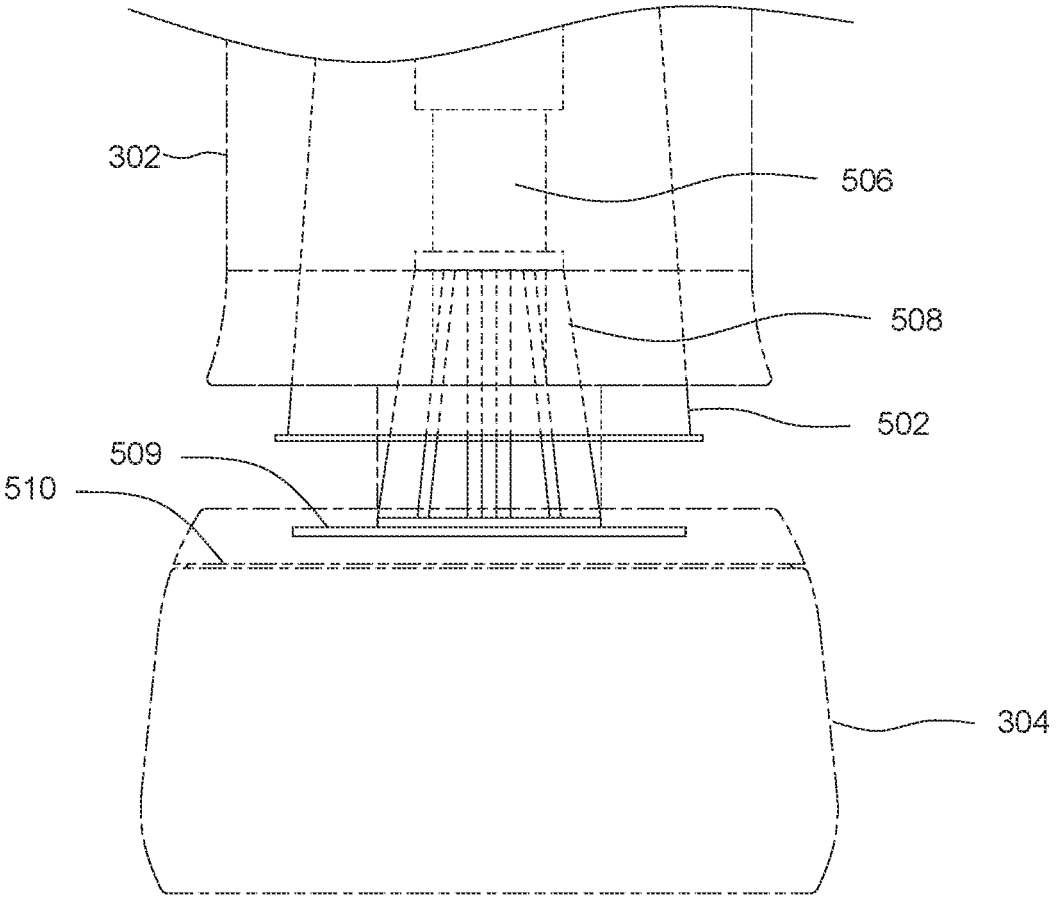
FIG. 9 depicts a cross section of the sliding plate area of training bag assembly shown in FIG. 6.

FIG. 6 depicts a cross section of a training bag assembly comprising a sliding plate in a resting position, and FIG. 7 depicts a cross section of a training bag assembly comprising a sliding plate in a deflected position, according to various embodiments of the present disclosure. FIG. 8 depicts a cross section of the gimbal area of training bag assembly shown in FIG. 6. Similarly, FIG. 9 depicts a cross section of the sliding plate area of training bag assembly shown in FIG. 6. For clarity, components similar to those shown in FIG. 5 are labeled in the same manner. For purposes of brevity, a description or their function is not repeated here.

Returning now to FIG. 7, in operation, gimbal 504, which may be located at or near to the top end of cone assembly 502, allows training bag assembly 500 to pivot in a direction denoted by arrow 702, thus, allowing the bottom of top portion 302 of training bag assembly 500 to move more than the bottom of top portion 302 in a direction denoted by arrow 704. In particular, cone assembly 502 and, thus, top portion 302 will rotate about gimbal 504 at a certain angle, causing shaft assembly 506 and intermediate shaft spring 508 to also rotate. Since sliding plate 509 is attached to intermediate shaft spring 508, sliding plate 509 will translate the rotary movement in direction 702 into a longitudinal movement in direction 704, e.g., until sliding plate 509, which compresses a shaft spring, comes to a halt and is accelerated back by the shaft spring in the reverse direction.

Figure 10:
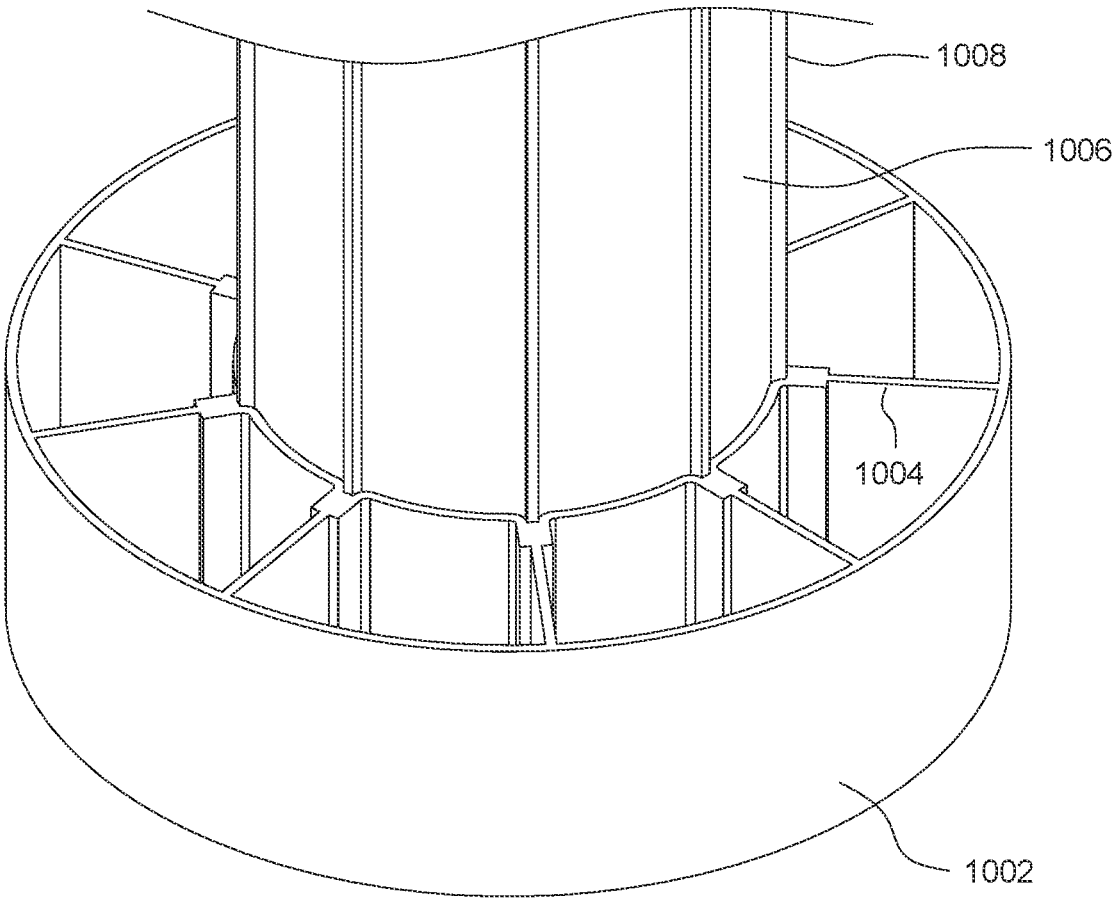
FIG. 10 depicts a perspective view of a cross section of the top portion of training bag assembly shown in FIG. 6.

FIG. 10 depicts a perspective view of a cross section of the top portion of training bag assembly shown in FIG. 6. As depicted, structure 1002 in FIG. 10 may be attached to shaft 1006 or support structure 1008 on shaft 1006, e.g., via any number of ribs (e.g., 1104) that may be spaced from each at a predetermined distance along the inner perimeter of structure 1002. In embodiments, structure 1002 may be manufactured by using an extrusion process. However, this is not intended a limitation on the scope of the present disclosure since other techniques such as, for example, plastic injection molding process, etc., may be used.

Unlike commonly used foam padding materials that tend to break down over time, thereby, reducing resistance against a force that is applied to such materials, in embodiments, structure 1002 may comprise relatively rigid polymer material. In operation, structure 1002, once depressed by a striking force both absorbs the energy and provides a resistance that emulates the inertia of a common heavy sandbag, thereby, providing a user feel of a punching heavy sandbag.

Various embodiments take advantage of the fact that inertia, at least partially, translates to the feel of a punch to adjust "punch feel" by adjusting the mechanical properties of structure 1002, e.g., by using a filling material between the ribs. After deflecting from its original shape, structure 1002 returns to its original position.

Figure 11:
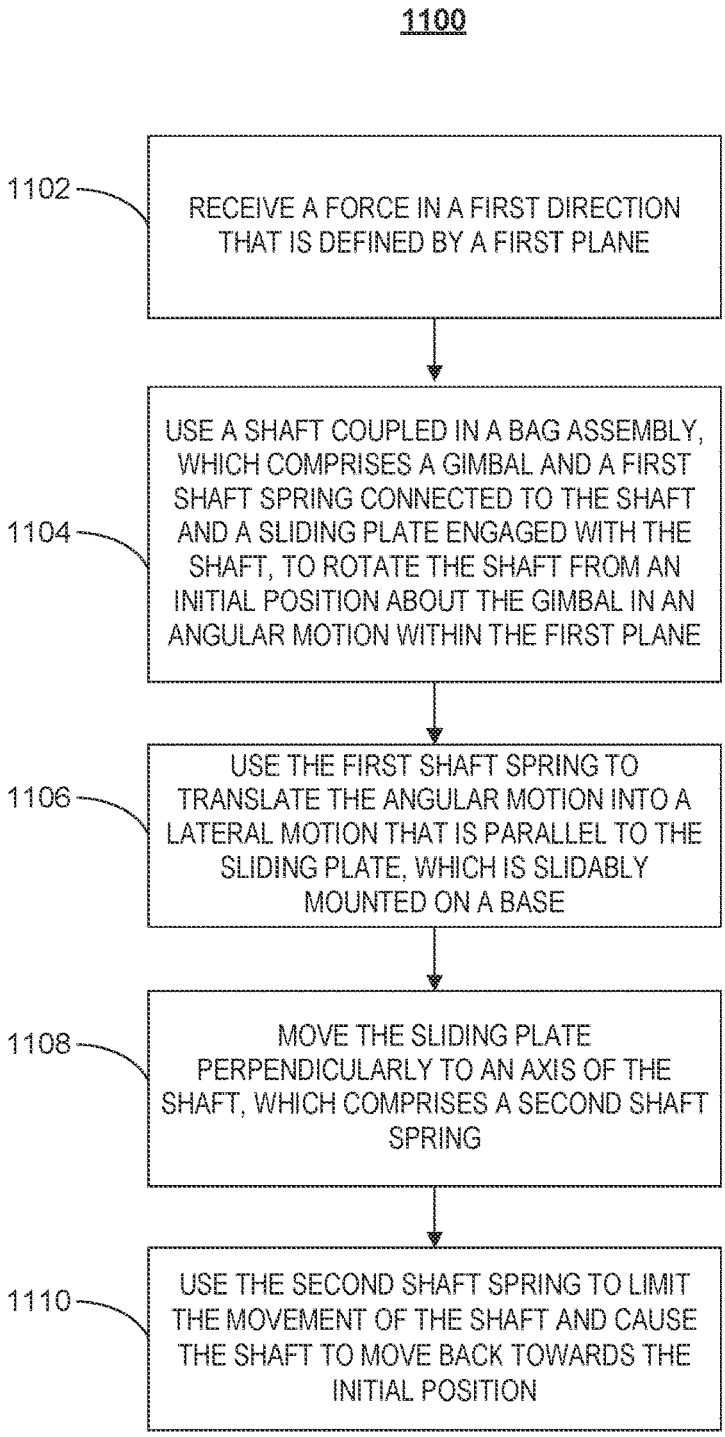
FIG. 11 is a flowchart of an illustrative process for using a training bag in accordance with various embodiments of the present disclosure.

FIG. 11 is a flowchart of an illustrative process for using a training bag in accordance with various embodiments of the present disclosure. In embodiments, process 1100 for using a training bag may start when, at step 1002, a force is received in a first direction.

At step 1004, a shaft that is coupled in a bag assembly is rotated from an initial position about a gimbal in an angular motion within the first plane. The bag assembly may comprise the gimbal and a first shaft spring that is connected to the shaft. The bag assembly may further comprise a sliding that is plate engaged with the shaft.

At step 1004, the first shaft spring may be used to translate the angular motion into a lateral motion that is parallel to the sliding plate. The sliding plate may be slidably mounted on a base.

At step 1006, the sliding plate may be moved perpendicularly to an axis of the shaft, which comprises a second shaft spring.

At step 1008, the second shaft spring may be used to limit the movement of the shaft and cause the shaft to move back towards the initial position.

One skilled in the art will recognize no computing system or programming language is critical to the practice of the present invention. It will be appreciated to those skilled in the art that the preceding examples and embodiments are exemplary and not limiting to the scope of the present disclosure. It is intended that all permutations, enhancements, equivalents, combinations, and improvements thereto that are apparent to those skilled in the art upon a reading of the specification and a study of the drawings are included within the true spirit and scope of the present disclosure. It shall also be noted that elements of any claims may be arranged differently including having multiple dependencies, configurations, and combinations.

What is claimed is:

1. A shaft assembly comprising:

a gimbal bearing;

a flexible member;

a shaft extending upward from the flexible member and comprising a first end to mate with the gimbal bearing and a second end to mate with the flexible member, the shaft, in response to a force in a first direction perpendicular to the shaft, performs an angular motion in a first plane;

a set of ball bearings;

a sliding plate cover comprising one or more recesses dimensioned to receive the set of ball bearings;

a sliding plate affixed to the flexible member, the sliding plate mates, via the set of ball bearings, with the sliding plate cover, the flexible member translates the angular motion into a lateral motion in the first direction; and a shaft spring to dampen the lateral motion.

2. The shaft assembly of claim 1, wherein the flexible member is a shaft spring assembly.

3. The shaft assembly of claim 2, wherein the shaft rotates within the first plane about a gimbal bearing.

4. The shaft assembly of claim 1, wherein the shaft spring limits the lateral motion and causes the shaft to return to a resting position.

5. The shaft assembly of claim 1, wherein the sliding plate comprises a ring-shaped contact surface.

6. The shaft assembly of claim 5, further comprising a set of ball bearings that slidably connect to the ring-shaped contact surface.

7. The shaft assembly of claim 6, wherein the sliding plate cover comprises one or more recesses dimensioned to receive the set of ball bearings.

8. A method for using a training apparatus, the method comprising:

in response to a force in a first direction that causes an angular motion of a shaft extending upward from a flexible member that is affixed to a sliding plate, which mates with a base, the flexible member translates the angular motion into a lateral motion in the first direction; and using a shaft spring to dampen the lateral motion.

9. The method of claim 8, further comprising using the angular motion to rotate the shaft about a gimbal bearing within the first plane.

10. The method of claim 8, wherein the first direction is defined by a first plane that is perpendicular to an axis of the base.

11. The method of claim 8, further comprising, using the shaft spring to limit the lateral motion and causing the shaft to return to a resting position.

12. The method of claim 11, further comprising using a set of ball bearings to slidably connect the sliding plate with a sliding plate cover that comprises one or more recesses dimensioned to receive the set of ball bearings.

13. A training apparatus comprising:

a base;

a shaft assembly comprising:

a gimbal bearing;

a flexible member;

a shaft extending upward from the flexible member and comprising a first end to mate with the gimbal bearing and a second end to mate with the flexible member, the shaft, in response to a force in a first direction perpendicular to the shaft, performs an angular motion in a first plane;

a set of ball bearings;

a sliding plate cover comprising one or more recesses dimensioned to receive the set of ball bearings;

a sliding plate affixed to the flexible member, the sliding plate mates, via the set of ball bearings, with the sliding plate cover, the flexible member mates with the base and translates the angular motion into a lateral motion in the first direction; and a shaft spring to dampen the lateral motion;

a cone-shaped assembly that at least partially envelopes the shaft; and a substantially cylindrical assembly that at least partially encloses the cone-shaped assembly and serves as a target for the force.

14. The training apparatus of claim 13, wherein the base comprises a hollow receptacle that is fillable with a solid, semi-solid, or liquid ballast to stabilize the training assembly.

15. The training apparatus of claim 13, wherein at least some portion of the shaft assembly is height-adjustable.

16. The training apparatus of claim 13, wherein the angular motion rotates the shaft about a gimbal bearing within the first plane.

17. The training apparatus of claim 16, wherein the first plane is perpendicular to an axis of the base.

18. The training apparatus of claim 13, wherein the shaft spring limits the lateral motion and causes the shaft to return to a resting position.

19. The training apparatus of claim 13, wherein the sliding plate comprises a ring-shaped contact surface.

20. The training apparatus of claim 19, wherein the set of ball bearings is slidably connect to the ring-shaped contact surface.

* * * * *